United States Patent [19]

Tooth et al.

[11] Patent Number: 4,462,866

[45] Date of Patent: Jul. 31, 1984

[54] SHEET MATERIALS

[75] Inventors: Alan J. Tooth, Whitchurch; Neil Pask, Newbury, both of England

[73] Assignee: Portals Limited, Hampshire, England

[21] Appl. No.: 350,027

[22] Filed: Feb. 18, 1982

[30] Foreign Application Priority Data

Feb. 19, 1981 [GB] United Kingdom ..... 8105278
Jul. 13, 1981 [GB] United Kingdom ..... 8121563

[51] Int. Cl.[3] ..... D21D 3/00

[52] U.S. Cl. ..... 162/103; 162/108; 162/109; 162/110; 162/116; 162/140

[58] Field of Search ..... 162/110, 103, 108, 109, 162/116, 140, 117, 124; 428/915, 916

[56] References Cited

U.S. PATENT DOCUMENTS 1,903,711 4/1933 Wendel .
3,720,578 3/1973 Heling et al. ..... 162/116

FOREIGN PATENT DOCUMENTS 341970 9/1918 Fed. Rep. of Germany .
2408304 4/1975 Fed. Rep. of Germany .
19963 of 1910 United Kingdom .
423281 1/1935 United Kingdom .
440421 1/1940 United Kingdom .
741675 12/1955 United Kingdom .
1127043 8/1974 United Kingdom .
1220464 1/1975 United Kingdom .
1447933 9/1976 United Kingdom ..... 162/110
1486079 9/1977 United Kingdom .
1525790 9/1978 United Kingdom .
1552853 9/1979 United Kingdom .
1604463 12/1981 United Kingdom .

OTHER PUBLICATIONS

Wochenblatt fur Papierfabrikation, nr. 19, 1957, FRG, pp. 740–741; P. Hornle: "Naturliche oder kunstliche Wasserzeichen", entire article.

*Primary Examiner*—Peter Chin
*Attorney, Agent, or Firm*—Buell, Blenko, Ziesenheim & Beck

[57] ABSTRACT

A sheet material such as paper is provided during manufacture with an elongate element partially disposed within the thickness of the paper sheet but exposed at spaced locations one one side of the sheet. The paper may be used in making security documents such as banknotes and checks.

9 Claims, 10 Drawing Figures

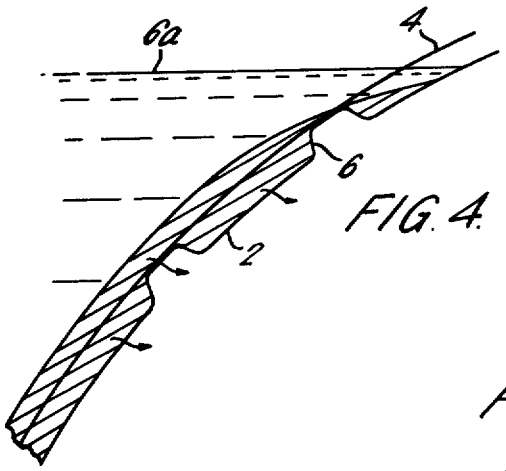
FIG. 4.
FIG. 5.
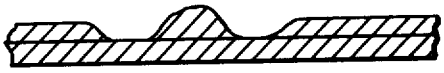
FIG. 6.
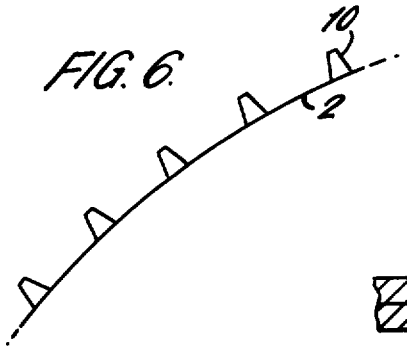
FIG. 6a.
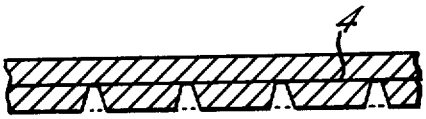
FIG. 6b.
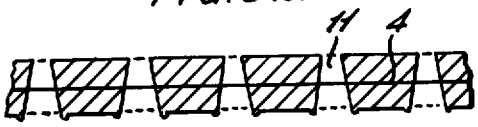

SHEET MATERIALS

FIELD OF THE INVENTION

This invention relates to sheet materials including papers and like materials formed by depositing fibres onto a support surface. More particularly, the invention relates to sheet materials having partially embedded therein an elongate element which is partially disposed within the thickness of the sheet but exposed at spaced locations.

By the term 'exposed' is meant that the elongate element is substantially more visible at 'exposed' areas than when disposed in the thickness of the sheet by virtue of being overlaid by little or none of the fibre material making up the sheet. It is, however, permitted that the sheet includes a transparent or translucent overlay which covers the 'exposed' areas of the elongate element.

The visual effect provided by the exposure of the elongate element may be for purely decorative purposes but in preferred embodiments of the invention the sheet is a security paper and the elongate element is a security feature.

BACKGROUND OF THE INVENTION

It is known to include elongate elements such as threads or ribbons of material such as plastics film, metal foil, metallised plastics and metal wire in the thickness of paper to render imitation of documents produced from the paper more difficult. To increase the security given by the included element, it has been proposed to endow the element itself with one or more verifiable properties over and above its presence or absence. Such properties include magnetic properties, electrical conductivity, the ability to absorb X-ray strongly and fluorescence.

Also it has been proposed in British Specification No. 1552853 to use a dichroic filter material as the elongate element and to provide apertures in the sheet so that the dichroic material is exposed on both sides at the same location and viewable by reflected or transmitted light. The dichroic material will have a different appearance when viewed in these different ways.

The techniques proposed for providing the said apertures all however suffer from the disadvantage that they are applied after the sheet containing the security element has been made.

SUMMARY OF THE INVENTION

The present invention provides a method for making a sheet which method comprises depositing fibres onto a support surface whilst providing an elongate element overlying the support surface, the deposition of fibres being carried out in such a manner that as fibres are deposited on the support surface to form the sheet the elongate element becomes generally incorporated in the sheet but is left at least substantially exposed as at least one surface of the sheet at a plurality of spaced locations.

The method of the invention may be carried out in a number of ways for instance, one method comprises depositing fibres onto a support surface having portions which are raised relative to adjacent areas of the surface, and providing an elongate element extending over the raised portions, the deposition being in such a manner that substantially no fibres are deposited between the raised portions and the overlying elongate element, whereby the elongate element becomes disposed within the thickness of the sheet formed by the deposition of fibres but at least substantially exposed at at least one surface of the sheet at a plurality of spaced locations.

Preferably, the fibres are deposited from a suspension in a fluid onto a fluid permeable support surface through which the fluid is withdrawn.

Preferably, the raised portions of the support surface are fluid permeable.

Preferably, the fibres are paper making fibres and are deposited from a suspension in a liquid.

Preferably, the elongate element is contacted with each raised portion of the support surface prior to any substantial amount of fibres being deposited over that raised portion.

Preferably, the support surface extends over a continuous path and is moved over the path so as to pass through a suspension of paper making fibres and the fibres are continuously deposited thereon to form a sheet which is continuously removed therefrom and an elongate element is continuously introduced to contact the support surface and lie over the raised portions of the support surface in turn before any substantial amount of fibres are deposited on the said raised portions.

The support surface may be provided by a wire mesh and in that case the raised portions thereon may be formed by embossing the wire mesh.

The raised portions may however be additions to the support surface, such as blocks attached to a wire mesh surface or 'arches' of wire or similar material mounted on the support surface.

The invention also provides a method of forming a sheet having an elongate element disposed within the thickness of the sheet but at least substantially exposed at at least one surface of the sheet at a plurality of spaced locations, which method comprises bringing the elongate element to lie over a support surface, and depositing sheet forming fibres on the support surface to form a sheet containing the elongate element within the thickness thereof, wherein means are provided on the support surface to produce a lesser rate of fibre deposition thereon at a plurality of spaced locations so as to cause the elongate element to be at least substantially exposed at at least one surface of the sheet at said locations.

The invention also provides a method for making a sheet which method comprises depositing fibres from a fluid suspension onto a surface of a pervious support by removal of the fluid through the support, the support comprising a plurality of spaced impervious portions, and providing an elongate element extending over the impervious portions, the deposition being such that the impervious portions restrict fibre deposition immediately above themselves so that the elongate element becomes disposed within the thickness of the sheet formed by the deposited fibres but at least substantially exposed at at least one surface of the sheet at a plurality of spaced locations.

The impervious portions may be raised above adjacent regions of the support surface or may not be so raised as desired.

Once again the support surface is preferably provided by a wire mesh.

Preferably the fibres are paper making fibres.

Preferably, in either of the methods described above the sheet is made on a cylinder mould paper making machine.

The invention includes a sheet made by a method of the invention described above.

Preferably the sheet is a paper sheet.

The paper may be a security paper and the elongate element may be a security element.

Such a security element may be a thread or ribbon of plastics or of metal and may be a thin film dichroic filter element, a magnetic element, an electrically conductive or phosphorescent element, a strongly X-ray absorbing element, a fluorescent element, an element incorporating a hologram or halographic effect, or a prismatic effect or incorporating a diffraction grating, or an element combining two or more of these properties. Other properties which may be possessed by the element include colour, emblems or messages thereon and variations in texture. Suitable elements are described in our British Patent Specification No. 1127043 and Application No. 51047/76. Dichroic materials are described in Specification No. 1552853.

Preferably, where the sheet is of paper, the elongate element lies in a watermark area of the paper.

Preferably, the locations at which the elongate element is exposed are in predetermined longitudinal register with some other marking or feature on the paper.

The sheet may be provided with a transparent or translucent overlay extending over at least the exposed portions of the elongate element. The overlay may be applied in register with exposed portions of the elongate element so as to cover substantially only each exposed portion. Alternatively the overlay may be applied over a larger area of the sheet, e.g. along a strip so as to cover a number of exposed portions of the elongate element and the areas of the surface between those exposed portions. If desired the overlay may extend over the whole of one or more of the surfaces of the sheets.

The overlay may be a film which is applied over the sheet and caused to adhere thereto, e.g. by adhesive. The overlay may be applied as a liquid and subsequently form a film adherent to the surface of the sheet. In such a case, the liquid may be applied in register with exposed portions of the elongate element e.g. by printing, more particularly "ink-jet" printing.

Where the overlay is applied as a film, it may for instance be a plastics film such as a polyethylene, or polyester film.

If the overlay is to be applied as a liquid it may be in the nature of a varnish, e.g. a polyurethane varnish, or may be a film forming latex such as will form a transparent or translucent film e.g. a polyvinylacetate latex. The liquid may be a solution of a polymer which forms a film upon evaporation of solvent. The liquid may be a liquid monomer or polymer precursor which cures to form a film in situ.

The provision of such an overlay helps to prevent the elongate element becoming detached from the sheet where it is exposed and forming loops which could lead to the elongate element becoming broken or being pulled out of the sheet The invention includes a security document comprising or produced from a sheet according to the invention and includes such security documents as banknotes, cheques, warrants, identity cards, guarantee cards and credit cards.

In addition to security papers, the invention is applicable to sheet materials generally, including wall coverings including wallpapers in which the partially enclosed elongate element may be a decorative feature, and also fibrous laminates. Decorative laminates often comprise several layers of resin impregnated Kraft paper with a decorative layer of fine quality paper which is printed with the desired pattern. This has a protective transparent layer thereover such as onion skin. The printed layer may be a sheet according to the present invention and the included elongate element may be a decorative feature.

When a sheet according to the invention has been formed with the elongate element substantially but not wholly exposed at spaced locations, steps may be taken to enhance the exposure of the elongate element by removing some or all of the fibres which are overlying it. Such steps may include brushing or sweeping the surface or directing a jet of fluid onto the surface of the sheet to dislodge such fibres.

Where a jet of fluid is exployed, the sheet may be caused to move through an exposure enhancement station and the jet of fluid may be activated only when a substantially exposed portion of the elongate element is in position in the station to be struck by the jet.

DESCRIPTION OF THE DRAWINGS

The invention will be illustrated by the following description of preferred embodiments with reference to the appended drawings in which:

FIG. 4 is an enlarged view of the circled area of FIG. 2.

FIG. 5 is a cross-section through the paper produced by the machine of FIG. 2.

FIG. 6 shows a profile of a wire mesh mould cover useable in accordance with the invention.

FIG. 6*a* and FIG. 6*b* show cross-sections through paper producible by methods according to the invention.

DETAILED DESCRIPTION OF THE INVENTION

Figure 1:
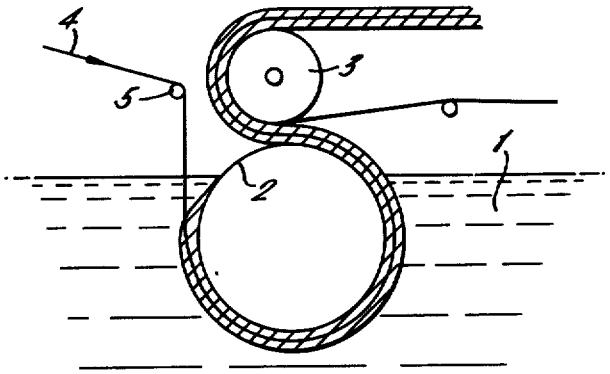
FIG. 1 is a schematic section through a cylinder mould paper making machine in normal operation inserting a security thread into the paper being made.

As seen in FIG. 1, a cylinder mould paper making machine comprises a vat containing a suspension of paper making fibres 1 in which dips the major portion of a cylinder 2 arranged with its axis horizontal. The surface of the cylinder 2 is provided by a wire mesh. Generally there are several layers of mesh employed, the outermost being the finest. Liquid is drawn through the mesh as the cylinder 2 is rotated causing paper making fibres to deposit on the mesh and form a sheet which is couched from the cylinder by couch roll 3 and conveyed away. A security thread 4 is continuously implanted in the paper. The thread is supplied from a bobbin and passes over a guide 5 e.g. a roller, and into the vat to contact the paper on the cylinder at such a depth that approximately half the desired thickness of paper fibres have been despoited. As the cylinder rotates, further paper fibres are deposited over the whole surface of the cylinder and the thread is buried. Although the term "thread" is employed in this description of specific embodiments, it is to be understood to include ribbons of film or foil, wires and any other suitable elongate elements for inclusion in paper.

It should be noted particularly that the thread is arranged to enter the liquid in the vat prior to contacting the cylinder so that the cylinder surface has already acquired a substantial coating of paper fibres before the thread makes contact.

Figure 2:
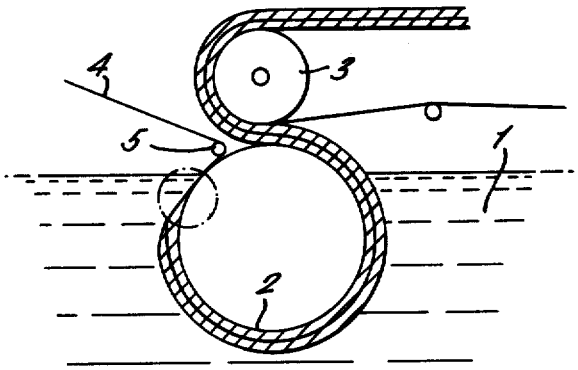
FIG. 2 is a schematic section through the machine of FIG. 1 modified for use in one method of the present invention.

In the modified machine shown in FIG. 2 and in detail in FIG. 4, the roller 5 is shifted so that the thread contacts the cylinder at a substantially higher point. The support surface provided by the wire mesh cylinder cover is provided with raised portions 6 by embossing (see FIG. 3). The thread is led into the vat so as to contact each raised portion 6 as the raised portion enters the vat so that the thread is lying over the raised portion as fibres begin to deposit, i.e. whilst still above the water level 6*a* (FIG. 4). Fibres are progressively deposited over the thread and also below the level of the thread except at the raised portions 6.

The effect on the paper produced is shown in FIG. 5 on a vertically exaggerated scale. Where the thread contacted a raised portion 6, the thread lies exposed on one surface of the paper (the mould side). The thread is continuously covered on the other side of the paper.

Figure 3:
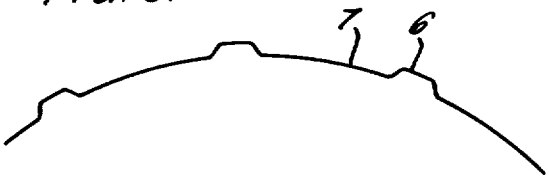
FIG. 3 shows the profile of an embossed wire mesh which may be used as the support surface in the apparatus of FIG. 2 making sheets according to one method of the invention.

In FIG. 4, it will be observed that the thread is shown bridging the gap between successive raised portions 6. To achieve this effect it may be necessary to apply somewhat greater tension to the thread than is conventional. The use of less tension can result in the thread conforming more to the surface of the valley between the raised portions 6. The exposed portion of the thread may then be longer than desired or, in extreme cases continuous. As an example, a 0.5 mm. wide ribbon of metallised plastics film might normally be at a tension of 100 grammes or less at the point of contact with the support surface. However, in order to cause such a ribbon to bridge the projections of the support surface as shown in FIG. 3, a tension in excess of 100 grammes may be required. For example, the required tension may be between 125 to 150 grammes. The actual tension required in practice will depend upon the nature of the elongate element employed and the effect desired. The tension may be provided by the resistance to turning of a bobbin from which the thread is continuously withdrawn by the rotation of the mould. Alternatively the thread may be delivered through a driven delivery means such as a pair of nip rolls having a surface speed slightly less than is required to match the demand of the mould.

The support surface shown in FIG. 3 is a wire mesh provided with raised portions 6 which are each about 0.75 mm high and 2 mm long in the paper making direction and which are separated by a valley 7 with a radiused cross-section at each end. Care should be taken that the valley 7 is not too small to permit sufficiently free entry of fibres from the paper making furnish to lie under the thread or else the exposed portion provided by the raised portions 6 will not be divided. In the surface illustrated, the radius of curvature at each end of the valley is approximately 1 mm. This pattern has been found suitable for use with a heavily beaten cotton furnish designed to produce an 80 g am dry paper. The dimensions of the valley needed to ensure deposition of fibres therein beneath the elongate element will naturally depend upon the average fibre length.

Although only three raised portions 6 are shown, it is preferred that there be a continuous line of such raised portions around the cylinder 2. The visual effect produced in the paper is then a line of short exposed sections of the thread on one side of the sheet.

The raised portions 6 used to produce the exposed portions of thread may form part of a more complex embossing on the wire cover of a cylinder mould, which more complex pattern produces the watermark of a watermarked paper.

In particular, at either side of the raised portions, small valleys whose lowest points lie below the general level of the support surface and valleys 7 may be incorporated. These cause an increase in paper thickness at each side of the exposed portion of the thread which serves to enhance the appearance, to define the exposed portion more clearly and to reinforce the sheet.

As described above the raised portions 6 shown in FIG. 3 are themselves permeable. However, these raised portions may if desired be impermeable and for instance may be provided by attaching plastics or metal to a nonembossed wire mould cover.

An example of a support surface in the form of a wire mesh mould cover bearing impervious raised portions is shown in FIG. 6. FIG. 6*a* shows the effect of such a support surface on the paper produced.

In FIG. 6, a row of impervious projections 10 are shown. When such a mould surface is used in apparatus as shown in FIG. 2 with sufficient tension being applied to the thread to make it bridge the valleys between the projections 10, the thread comes to lie on the top of the projections 10 before paper fibres are deposited and becomes embedded in the paper as it is formed. The projections shown each occupy a sufficiently small area of the mould surface that they have little effect on the local rate of fibre deposition and the surface of the paper remote from the mould is largely unaffected. The impervious projections act in the same manner as the pervious projections in the embodiment of FIG. 3.

FIG. 6*b* shows the effect on the paper of making the impervious projections of FIG. 6 larger relative to the mean fibre length of the paper making stock.

As before, the thread is exposed on the mould side of the paper through contact with the projections. However, the size of the projections is now sufficient to affect the local rate of fibre deposition and fibres are in fact not deposited above the projections because of the lack of drainage of the suspending fluid at those points. Fibres deposited over the permeable parts of the mould are not sufficiently long the bridge over the non-permeable parts. Thus holes 11 are formed in the paper over the impervious projections 10 and the thread is exposed on both sides of the finished paper.

It should be observed that when the impervious projections are so large in transverse area that they block fibre deposition thereabove, it is not necessary that the thread be arranged to lie over the projections before fibre deposition commences in order that the thread be exposed on the mould side of the paper.

Indeed, where impervious areas of the mould surface are employed which are of sufficient size relative to the fibres to be deposited, there may be no need for these portions to be raised above adjacent parts of the mould surface. It is possible to rely entirely on the blocking of drainage by the impervious regions to provide exposure of the elongate element on one or both surfaces of the sheet.

When raised portions are provided, they may be partially pervious and partially impervious. For instance pervious raised portions may have impervious bodies such as bars mounted at their tops. Similarly, the same support surface may incorporate raised and/or depressed pervious portions in some locations and impervious portions in others.

It is desirable that the position of the exposed portions be in fixed register relative to the sheet so that document sized portions of the sheet may be cut at predetermined positions in such a way that the edges of the cut portions do not coincide with an exposed portion of the element.

Figure 7:
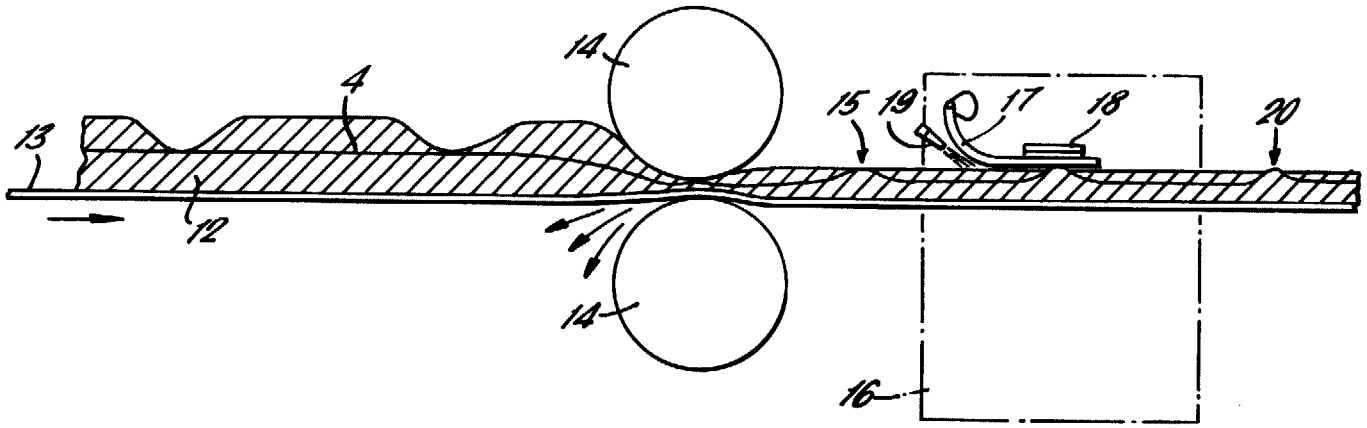
FIG. 7 shows apparatus for enhancing the exposure of an elongate element.

FIG. 7 illustrates one method of enhancing the exposure of the elongate element.

FIG. 7 shows the paper 12 after couching being conveyed on a conveyor 13. The paper 12 passes through the nip of a pair of press rolls 14 where water is expelled and the paper emerges considerably compressed. The thread 4 is substantially exposed at periodic locations 15 but is still overlaid by a small amount of paper. The paper enters an enhancement unit 16 wherein it runs under a flexible tongue 17, weighted to contact the paper with the desired force by weight 18. A jet 19 sprays water onto the paper just before it runs under tongue 17 in order to lubricate the tongue and to mobilise the paper fibres.

The paper emerges from the unit 16 with the thread 4 fully exposed at spaced locations 20.

Figure 8:
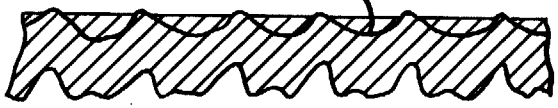
FIG. 8 shows a cross-section through a further sheet made in accordance with the invention.

FIG. 8 shows a cross-section through a further paper made according to the invention. This paper is obtained by depositing fibres onto a wire mesh cover of the kind shown in FIG. 3 but having higher raised portion 6, sufficiently high indeed to extend out from the mesh surface by more than the normal sheet thickness. The thread has been laid into the sheet under relatively low tension and has been introduced into the furnish so as to contact the raised portion after some deposition of paper fibres has occured on their top surfaces. No substantial deposition occurs over the thread 4 at the top of each raised portion because of washing off and other effects. Deposition will occur to bury the remainder of the thread however. The result is that the thread is periodically exposed on the couching side of the finished paper. The raised portions are sufficiently large to constitute means to cause a decrease in the rate of fibre deposition locally resulting in an exposed thread. Due to the low tension the thread does not lie straight from high point to high point but conforms to the valleys between raised portions.

Although the invention has been illustrated with reference to security papers, the methods described above are readily adaptable to the making of other products in which the exposed elongate element has a different role, e.g. a decorative function.

Furthermore, the use of a cylinder mould paper making machine is not essential to the manufacture of products according to the invention and a suitable manner of using other types of machines, such as Fourdrinier machines, generally employed for making paper and like materials will readily occur to those skilled in the art. For instance. a paper making machine of the kind described in our British Patent No. 1447933 may be employed.

We claim:

1. A method for making a sheet of paper for security documents by drawing fibres from a liquid suspension of fibres through a forming support surface and depositing them onto said forming support surface which method comprises disposing a continuous elongate security element on the forming support surface which forming support surface is modified so that as fibres are drawn from the suspension onto the forming support surface the elongate security element becomes generally incorporated in the sheet but is left at least substantially exposed at at least one surface of the sheet at a plurality of spaced locations wherein the modified forming support surface has portions which are raised relative to adjacent areas of the surface, and the elongate element is disposed to extend over the raised portions, the deposition of fibres being in such a manner that substantially no fibres are deposited between the raised portions and the overlying elongate element, whereby the elongate element becomes generally disposed within the thickness of the sheet formed by the deposited fibres but at least substantially exposed at least one surface of the sheet at a plurality of spaced locations.

2. A method as claimed in claim 1 wherein the modified forming support surface extends over a continuous path and is moved over the path so as to pass through the suspension of the fibres in a fluid and the fibres are continuously deposited thereon to form a sheet which is continuously removed therefrom and wherein the elongate element is continuously introduced to contact the modified forming support surface and lie over the raised portions of said forming support surface in turn before any substantial amount of fibres are deposited on said raised portions.

3. A method as claimed in claim 2 wherein the raised portions of the modified forming support surface are fluid permeable.

4. A method as claimed in claim 1 wherein means are provided on the raised portions of the modified forming support surface to produce a lesser rate of fibre deposition thereon at a plurality of spaced locations so as to cause the elongate element to be at least substantially exposed at at least one surface of the sheet at said locations.

5. A method as claimed in claim 4 wherein each of said raised portions of the modified forming support surface is generally previous but incorporates a plurality of spaced impervious portions serving to restrict fibre deposition immediately above themselves so that the elongate element becomes disposed within the thickness of the sheet formed by the deposited fibres but at least substantially exposed at at least one surface of the sheet at a plurality of spaced locations.

6. A method as claimed in claim 1 wherein the forming support surface is provided by a wire mesh.

7. A method as claimed in claim 1 wherein the sheet is made on a cylinder mould paper making machine.

8. A method as claimed in claim 1 wherein the fibres are paper making fibres.

9. A method as claimed in claim 1 wherein the elongate element is a security element chosen from the group consisting of a thin film dichroic filter element, a magnetic element, and electrically conductive element, a strongly X-ray absorbing element, a fluorescent element an element incorporating a hologram, an element providing a prismatic effect, an element incorporating a diffraction grating and an element combining more than one of these properties.

* * * * *

UNITED STATES PATENT AND TRADEMARK OFFICE

CERTIFICATE OF CORRECTION

PATENT NO. : 4,462,866

DATED : July 31, 1984

INVENTOR(S) : ALAN J. TOOTH; NEIL PARK

It is certified that error appears in the above-identified patent and that said Letters Patent is hereby corrected as shown below:

Column 4 line 19, change "exployed" to --employed--.

Claim 5, line 46, change "previous" to --pervious--.

Signed and Sealed this

*Twenty-eighth* Day of *May 1985*

[SEAL]

*Attest:*

DONALD J. QUIGG

*Attesting Officer* *Acting Commissioner of Patents and Trademarks*